US007878351B2

(12) United States Patent
Falzoni et al.

(10) Patent No.: US 7,878,351 B2
(45) Date of Patent: Feb. 1, 2011

(54) CAP ARRANGEMENTS

(75) Inventors: Alessandro Falzoni, Imola (IT); Fabrizio Pucci, Castel Guelfo (IT)

(73) Assignee: Sacmi Cooperativa Meccanici Imola Societa Cooperativa, Imola (BO) (IT)

( * ) Notice: Subject to any disclaimer, the term of this patent is extended or adjusted under 35 U.S.C. 154(b) by 729 days.

(21) Appl. No.: 10/567,452

(22) PCT Filed: Dec. 15, 2003

(86) PCT No.: PCT/EP03/14250

§ 371 (c)(1),
(2), (4) Date: Mar. 22, 2006

(87) PCT Pub. No.: WO2005/014414

PCT Pub. Date: Feb. 17, 2005

(65) Prior Publication Data

US 2006/0283828 A1 Dec. 21, 2006

(30) Foreign Application Priority Data

Aug. 7, 2003 (IT) ..... MO2003A0232

(51) Int. Cl.
*B65D 43/00* (2006.01)

(52) U.S. Cl. ..... 215/252; 215/215; 215/317; 215/329; 215/330; 215/331; 220/276; 220/288

(58) Field of Classification Search ..... 215/215, 215/252, 317, 329, 330, 331; 220/276, 288
See application file for complete search history.

(56) References Cited

U.S. PATENT DOCUMENTS 4,546,892 A 10/1985 Couput
4,801,030 A 1/1989 Barriac
5,096,079 A 3/1992 Odet
5,611,446 A * 3/1997 Ingram et al. ..... 215/252

(Continued)

FOREIGN PATENT DOCUMENTS

EP 0 541 466 A1 5/1993

(Continued)

OTHER PUBLICATIONS

International Search Report of PCT/EP03/14250, dated Nov. 18, 2004.

*Primary Examiner*—Anthony Stashick
*Assistant Examiner*—Elizabeth Volz
(74) *Attorney, Agent, or Firm*—Nixon & Vanderhye, PC

(57) ABSTRACT

A Cap arrangement comprises an opening-indicator device that has an outer edge wherefrom leads away fin members which in use extends towards the inside of said cap arrangement, said fin members comprising, in one of their portions nearest said edge, an elongated element having a substantially rectilinear extension, said fin members further comprising, in one of their portions further away from said edge, a flexible appendage elements; a cap arrangement comprises an opening-indicator device that has an outer edge wherefrom leads away fin members comprising a first portion suitable for interacting with a surface of a first collar arrangement extending radially from a neck of container arrangement, a second portion suitable for interacting with a further surface of a second collar arrangement extending radially from said neck and a third portion suitable for interacting with a yet further surface of said first collar arrangement.

19 Claims, 11 Drawing Sheets

U.S. PATENT DOCUMENTS

| | | | | |
|---|---|---|---|---|
| 5,695,083 | A | 12/1997 | Obadia | |
| 6,006,930 | A * | 12/1999 | Dreyer et al. | 215/44 |
| 2001/0002661 | A1 | 6/2001 | Reidenbach | |

FOREIGN PATENT DOCUMENTS

| | | | |
|---|---|---|---|
| JP | 62-11745 | | 1/1987 |
| JP | 3-10280 | | 1/1991 |
| JP | 5-86844 | | 11/1993 |
| JP | 6-16249 | | 3/1994 |
| JP | 08-164958 | | 6/1996 |
| JP | 2001-072102 | | 3/2001 |
| WO | 02/14170 | A1 | 2/2002 |
| WO | 03/016161 | A1 | 2/2003 |

* cited by examiner

CAP ARRANGEMENTS

This application is the U.S. national phase of international application PCT/EP2003/014250, filed 15 Dec. 2003, which designated the U.S. and claims priority of IT MO2003A000232, filed 7 Aug. 2003, the entire contents of each of which are hereby incorporated by reference.

The invention relates to cap arrangements that can be associated with containers, in particular cap arrangements provided with an opening-indicator device comprising a security-ring system and fin members arranged to interact with a neck of the containers.

Are already known caps that consist of a cylindrical skirt comprising a first portion, cooperating with a base wall to define a closure element that can be associated with a container and a second portion that constitutes an opening-indicator device suitable for informing a user about the integrity of a product packaged in said container.

The aforesaid second portion comprises a ring suitable for interacting with a projection obtained in the neck of the container.

Such first portion and second portion are separated by a nominal opening line consisting of a plurality of cuts, or openings, passing through the cylindrical skirt and being spaced by further bridge portions that extend between the first portion and the second portion and are designed to be broken during the first opening of the cap.

From an edge zone of the ring a plurality of fins lead away which—during use—point inwards and towards an upper part of said cap.

When the cap is opened for the first time, the fins interact with the projection to prevent detachment of the ring from the neck of the container and to promote breaking of the further bridge portions.

In order to prevent the fins being overturned around said edge zone without causing the breakage of the bridge portions, it was proposed to provide the fins with a body of considerable thickness arranged to interact with the projection, and with an appendage projecting from said body and that is received, during use, in a gap defined between the cap and the neck and that is pointed parallel to the neck.

In particular, U.S. Pat. No. 4,546,892 provides for a cap comprising a plurality of fins projecting from an opening-indicator ring.

Each fin constituted by a body of considerable thickness wherefrom a protrusion leads away that is arranged to interact with a projection obtained in the neck of a container in order to prevent the fin from overturning during opening.

A drawback of the above-disclosed cap, consists of the fact that the presence of the protrusion reduces the extension of the active surface of the fins.

Furthermore, owing to the great thickness of the body of the fins, great torque is required to apply the cap to the respective container, in such a way as to force the body of great thickness of each one of the fins beyond the projection.

This means that the bridge portions with which the cap is provided must have a cross-section of considerable extent in order not to become broken when the cap is applied to the neck of the container.

Consequently, the bridge portions may be so resistant that they do not break at the first opening, thus causing the fins to overturn and the ring to slip off the collar without separating from the body of the cap.

Furthermore, such a cap may be rather inconvenient for the user since it is difficult to open because of the great resistance that the bridge elements oppose to breaking.

U.S. Pat. No. 5,096,079 provides for a cap provided with fins comprising a curved part connected by means of plastic hinge with an opening-indicator ring, and a rectilinear part extending from the curved part.

Between the curved part and the rectilinear part a connecting zone is provided that is arranged to interact, during use, with a projection obtained in the neck of a container whereupon the afore-said cap has been applied.

Each fin has a constant cross-section, in such a way as to have uniform deformability along its entire extent.

In this way, the operations of mounting the cap on the neck of the container are simplified.

A drawback of the above-disclosed cap consists of the fact that, due to the great deformability of the curved part, it is necessary to rotate the cap at a large angle before the bridge elements are broken that connect the opening-indicator ring to a body of said cap, which is screwed onto said neck.

A further drawback of the above-disclosed cap, consists of the fact that the fins must be rather precisely sized.

In particular, the transversal dimension of the fins must be sufficiently limited to enable easy insertion of the cap on the neck, but at the same time be sufficiently extended to prevent excessive deformation thereof during the opening phase and therefore to prevent excessively prolonged opening times and losses of content before breaking of the bridge elements.

A yet further drawback of the above-disclosed cap consists of the fact that the major deformation to which the fins are subjected during opening may induce said fins to become flattened against the internal wall of the caps, to slide in relation thereto and to rotate towards the outside of the cap.

The cap disclosed in U.S. Pat. No. 5,096,079, although it can be more easily applied to a neck of a container than can the cap disclosed in U.S. Pat. No. 4,546,892, cannot nevertheless prevent an undesired overturning of the fins.

The known caps have a body that is internally provided with a thread that is suitable for engaging with a corresponding thread obtained in the neck of a container.

Are already known caps provided with a helical thread with a single start, i.e. defining a single cylindrical helix.

Said thread has a pitch of 3 millimeters.

The cylindrical helix extends at an angular extension that is greater than 360°.

Such caps ensure a satisfactory seal, inasmuch as a section of thread having a large extent remains engaged before the bridge elements are broken.

One drawback of the above-disclosed caps consists of the fact that the cap must have a considerable length inasmuch as a helix must be made therein with rather a large angle.

Are further already known caps provided with a helical thread with three starts, i.e. defining three mutually parallel cylindrical helixes.

Each one of said helixes has a 9 millimeter pitch.

Each cylindrical helix extends at an angle of about 120-180°.

Said caps enable a significant saving of material to be achieved inasmuch as the cylindrical helixes, because of their limited angle, can also be obtained in caps having a limited length.

A drawback of the above-disclosed caps consists of the fact that losses of fluid from the containers with which the caps are associated before breaking the bridge elements may occur.

In this case, in fact, when the opening-indicator ring interacts with the projection obtained in the neck, only sections of the thread of the caps having a limited extension engage with corresponding thread sections of the necks.

An object of the invention is to improve known cap arrangements.

Another object of the invention is to obtain cap arrangements provided with fin members that promote rapid and effective detachment of the opening-indicator device from a body of the arrangements.

A further object is to obtain cap arrangements in which is prevented overturning of the fin members during opening of a container with which said cap arrangements are associated.

In an aspect of the invention, there is provided a cap arrangement comprising an opening-indicator device having an outer edge wherefrom lead away fin members that in use extend towards the inside of said cap arrangement, said fin members comprising, in one of their portions nearest said edge, an elongated element having a substantially rectilinear extension, wherein said fin members further comprise, in one of their portions further away from said edge, flexible appendage elements.

In an embodiment, the appendage elements are mobile between a folded configuration, in which said appendage elements are contained in the thickness of said elongated element, and an extended configuration, in which said appendage elements extend substantially transversely in relation to said elongated element.

During the first opening of the cap, the fin members are made to interact with a projection obtained in a neck of a container with which the cap arrangement is associated, in order to prevent the opening-indicator device from being detached from said neck.

During afore-said interaction, the elongated element is substantially subjected to compression stress that generates deformation of the fin members by a rather limited amount.

This cause rapid breaking of bridge elements connecting the opening-indicator device to a body of the cap arrangement.

In particular, said breakage occurs when the seal between the cap arrangement and the respective container is still assured.

The flexible appendage elements are shaped in such a way as to partially envelope said projection in such a way as to prevent the overturning of the fin members.

As the appendage elements, in the folded configuration, are contained within the thickness of the elongated element, the fin members, as a whole, have a transversal dimension that is rather limited and therefore has good deformability if subjected to stress directed radially from the centre of the cap arrangement towards the periphery thereof.

This enables easy fitting of the cap arrangement on the neck of the container, inasmuch as the elongated element and the flexible appendage elements do not oppose a particularly significant resistance when they are pushed beyond the projection during container-closing operations.

This furthermore enables to create bridge elements that are arranged to connect the opening-indicator device to a body of the caps and that have a cross-section with a limited extent, inasmuch as the cap arrangement does not require high torque values to be applied to the neck of the container.

In this way, the bridge elements oppose less resistance and can easily be broken by a user during the first opening of the container.

Consequently, the risks of removing the opening-indicator device from the container during said first opening are drastically reduced, or are even completely eliminated.

In a further aspect of the invention, there is provided a cap arrangement comprising an opening-indicator device that has an outer edge wherefrom fin members lead away that in use extends towards the inside of said cap arrangement, said fin members comprising, in one of their portions nearest said edge, an elongated element having a substantially rectilinear extension, wherein said fin members furthermore comprise, in one of their portions further away from said edge, flexible appendage elements extending transversely in relation to said elongated element.

Owing to this aspect of the invention, the fin members have a contact zone with a projection obtained in a neck of a container, the projection having a considerable extent. This enables particularly effective fin members to be obtained.

Furthermore, the use of the flexible appendage elements induces the elongated element to be substantially subjected to compression stress.

In another aspect of the invention, there is provided cap arrangement comprising an opening-indicator device that has an outer edge wherefrom fin elements lead away which in use extends towards the inside of said cap arrangement, wherein said fin elements comprise a first portion suitable for interacting with a surface of a first collar arrangement extending radially from a neck of a container, a second portion suitable for interacting with a further surface of a second collar arrangement extending radially from said neck and a third portion suitable for interacting with yet further surface of said first collar arrangement.

Owing to this aspect of the invention, a cap arrangement can be obtained that is provided with fin members that are not subject to overturning during opening of the container.

The fin members are subjected to deformation of limited amount, which enables the bridge elements of said opening-indicator device to be rapidly broken.

In a still further aspect of the invention, there is provided a cap arrangement, comprising a threaded device suitable for engaging in a corresponding further threaded device obtained in a container arrangement with which said cap arrangement can be associated, wherein said threaded device comprises a double-start thread.

In one embodiment, the double-start thread comprises a pair of cylindrical-helix threads, extending parallel to one another and having a pitch of 4.5 millimeters.

Owing to this aspect of the invention, cap arrangements can be obtained provided with a limited length and, consequently, the consumption of material with which said cap arrangement are made can be limited.

At the same time, a cap arrangement can be obtained that prevents a product from leaving a container with which the cap arrangement is associated before breaking the bridge elements of the opening-indicator device associated with said cap device.

The invention will be better understood and carried out with reference to the attached drawings, showing some exemplifying and not limitative embodiments thereof, in which.

Figure 1:
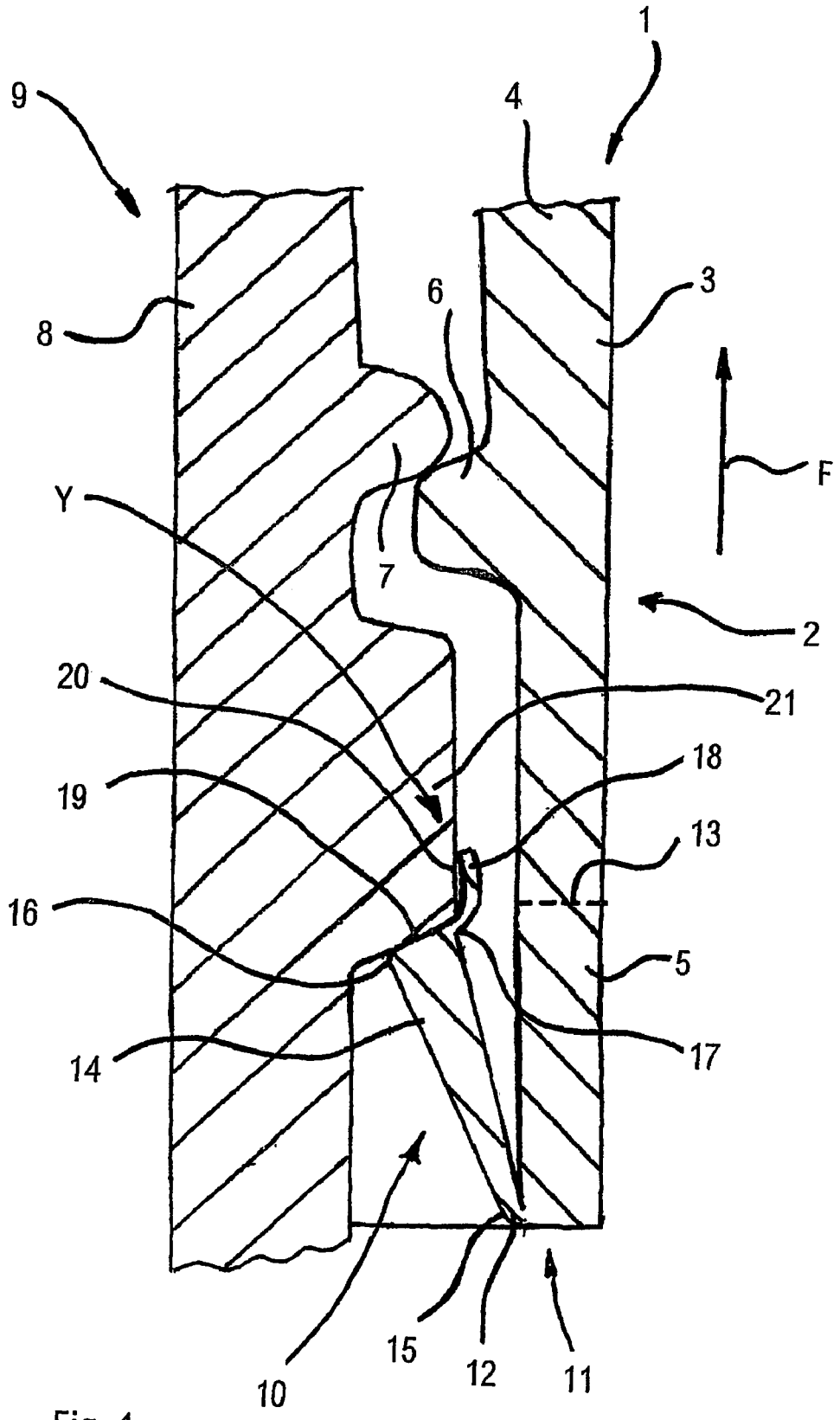
FIG. 1 is a partial cross-section taken along a transverse plane of cap arrangement according to the invention, showing fin members of the cap arrangement in one configuration.

With reference to FIGS. 1 to 4 it has been showed a cap 1 comprising a cylindrical skirt 2 that defines a lateral surface 3 of a body 4 of the cap 1 and an opening-indicator rind 5.

The cap 1 may be made of plastic material through compression-forming or through injection moulding.

In the cylindrical skirt 2 are obtained a plurality of through cuts or openings that define a nominal opening line 13 of the cap 1.

Between adjacent through cuts are identified bridge elements arranged to connect the body 4 to the closing-indicator ring 5, these bridge elements being suitable for being broken when the cap 1 is opened for the first time.

In the body 4 is obtained a thread 6 suitable for engaging with a corresponding further thread 7 obtained in a neck 8 of a container 9 with which the cap 1 can be associated.

The opening-indicator ring 5 is provided with one or more fins 10 that lead away from an external edge 11 thereof.

The fins 10 are arranged to interact with a projection 21 made in the neck 8.

The fins 10 encourages the breaking of the bridge elements and prevents the detachment of the opening-indicator ring 5 from the neck 8 during the first opening of the container 9.

The opening-indicator ring 5 comprises a deformable zone 12 that acts as plastic hinge suitable for connecting the fins 10 to the opening-indicator ring 5.

Before the cap 1 is associated with the container 9, the fins 10 are folded inside the opening-indicator ring 5.

This may occur through a dedicated folding operation, or through the interaction of the fins 10 with the neck 8 of the container 9.

The fins 10 comprise an elongated element 14 having a first end 15 connected with the deformable zone 12 and a second end 16, opposite the first end 15, to which a further first end 17 of an appendage 18 is connected.

The appendage 18 has rather limited thickness, in such a way as to be provided with high deformability.

Furthermore, thanks to the limited thickness of the appendage 18, the fin 10 has a zone 19 of interaction with the projection 21 having a considerable extent.

Figure 2:
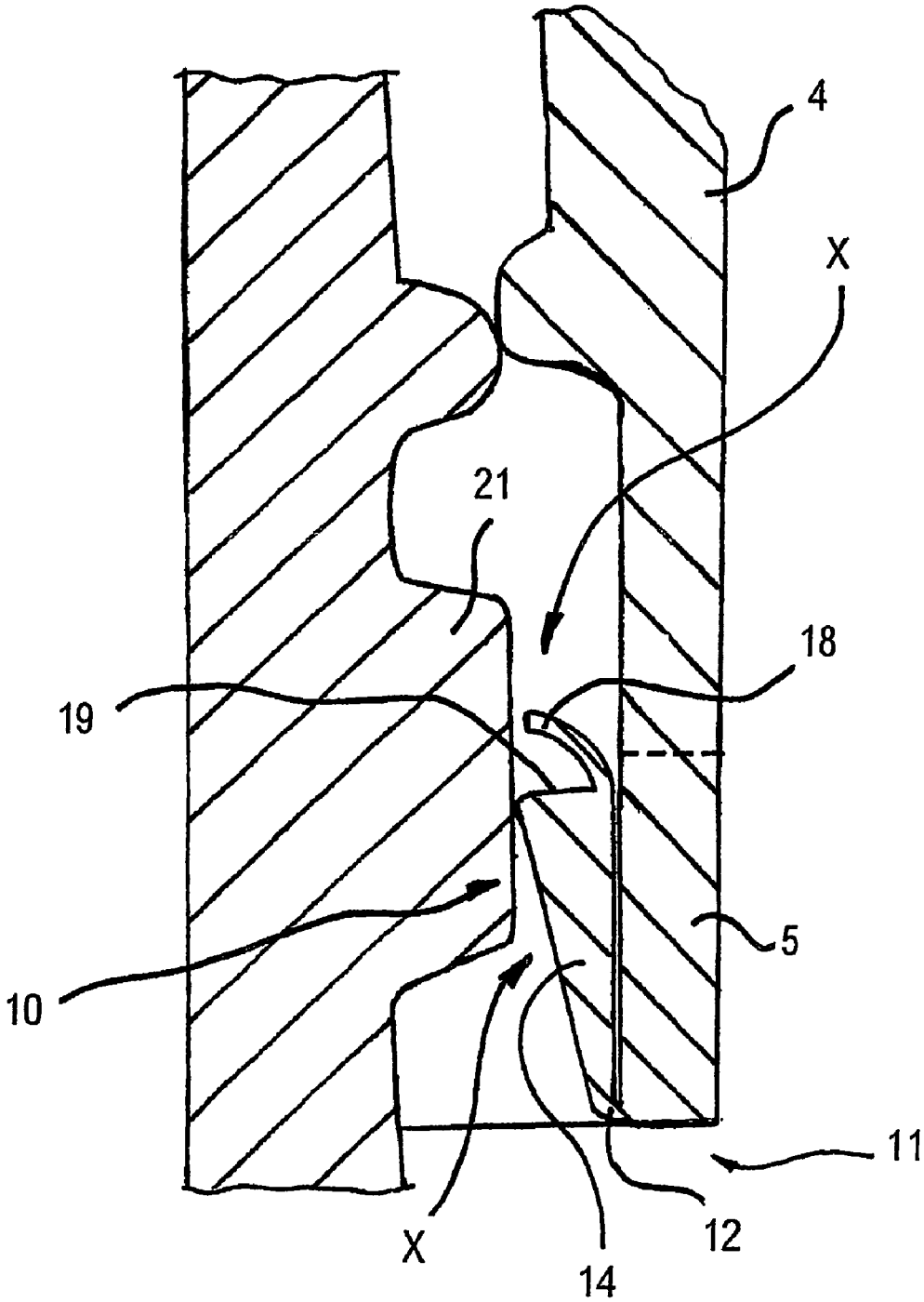
FIG. 2 is a cross-section like the one in FIG. 1, showing the fin members in a different configuration during the application of the cap arrangement to a neck of a container.

The appendage 18 is mobile between a folded configuration, indicated with X in FIG. 2, in which the appendage 18 is contained within the thickness of the elongated element 14, and an extended configuration, indicated with Y in FIG. 1, in which the appendage 18 extends substantially transversely from the elongated element 14 to interact with the projection 21.

The appendage 18, in the extended configuration Y, partially surrounds the projection 21 in such a way as to prevent overturning of the fin 10 around the deformable zone 12 acting as hinge during the first opening of the container 9, i.e. when the cap 1 is translated in the direction indicated with arrow F.

In order to make the resistance to the overturning of the fin 10 more effective, the appendage 18 may be shaped in such a way as to interact in a shapingly coupled manner with the projection 21.

The elongated element 14 is mainly subjected to compression stress and to a deformation of limited entity that promotes rapid breaking of the bridge elements.

As in the folded configuration X the appendage 18 is contained in the thickness of the elongated element 14, the fin 10 as a whole is slimmer than the fins known in the state of the art, and it is therefore provided with greater deformability if subjected to stress directed radially from the centre of the cap 1 towards the periphery of the latter.

This enables the operations of mounting the cap 1 onto the container 9 to be significantly simplified inasmuch as the fins 10 do not oppose excessive resistance when they are forced to pass beyond the projection 21 at the positioning of the cap 1 on the neck 8.

This furthermore enables bridge elements having a limited surface cross-section to be made, inasmuch as the capsule 1 does not need to be subjected to a torque of considerable value to be applied to the neck 8.

Figure 3:
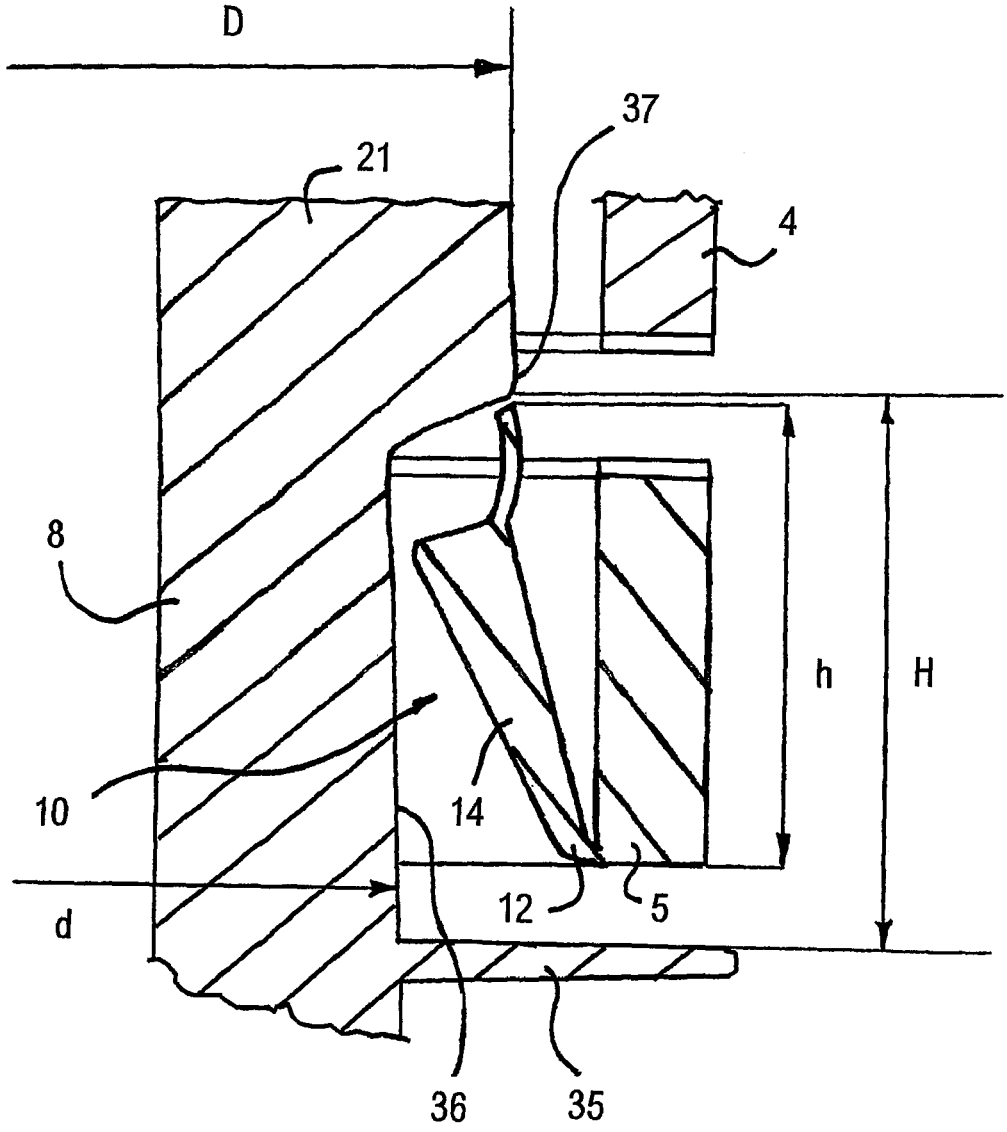
FIG. 3 is a cross-section like the one in FIG. 1, showing the fin members after the opening-indicator device of the cap arrangement has been separated from a body of the cap arrangement, once a first opening of the container has occurred.

As shown in FIG. 3, once the body 4 of the cap 1 has been separated from the opening-indicator ring 5, the appendage 18 of each one of the fins 10 tends to pass from the extended configuration Y to the folded configuration X, thereby removing the opening-indicator ring 5 from the projection 21.

Thus, if the body 4, after the first use of the container 9, is screwed again on the neck 8, owing to the presence of the appendages 18, the opening-indicator ring 5 is maintained at a given distance from the body 4.

In this way, a clearer indication that the cap 1 has been opened and that any tampering with the container 9 to which the cap 1 is associated has occurred, is obtained.

In particular, the fin 10 has a thickness that is less than the difference between the diameter D of the projection 21 and the diameter d of the neck 8.

The fin 10 has furthermore a height h that is less than the distance H between a lower part 37 of the projection 21 and a disc 35 radially projecting from the neck 8.

In this way, once the container 9 has been opened for the first time, the fin can be accommodated inside a space 34 defined by the projection 21, by the disc 35 and by a portion 36 of the neck 8 comprised between the projection 21 and the disc 35.

In an embodiment, the nominal opening line 13 may extend only for a portion of the development of the cap rather than for the entire extent of the circumference thereof.

The nominal opening line 13 may comprise a cut, or an incision, or a weakening, obtained in the lateral surface 3 of the cap 1.

In addition, the opening-indicator ring 5 may be provided with a vertical cut that crosses its entire thickness.

In this case, once the bridge elements have been broken, the opening-indicator ring 5 remains connected with the body 4 and detaches itself from the neck 8.

Figure 4:
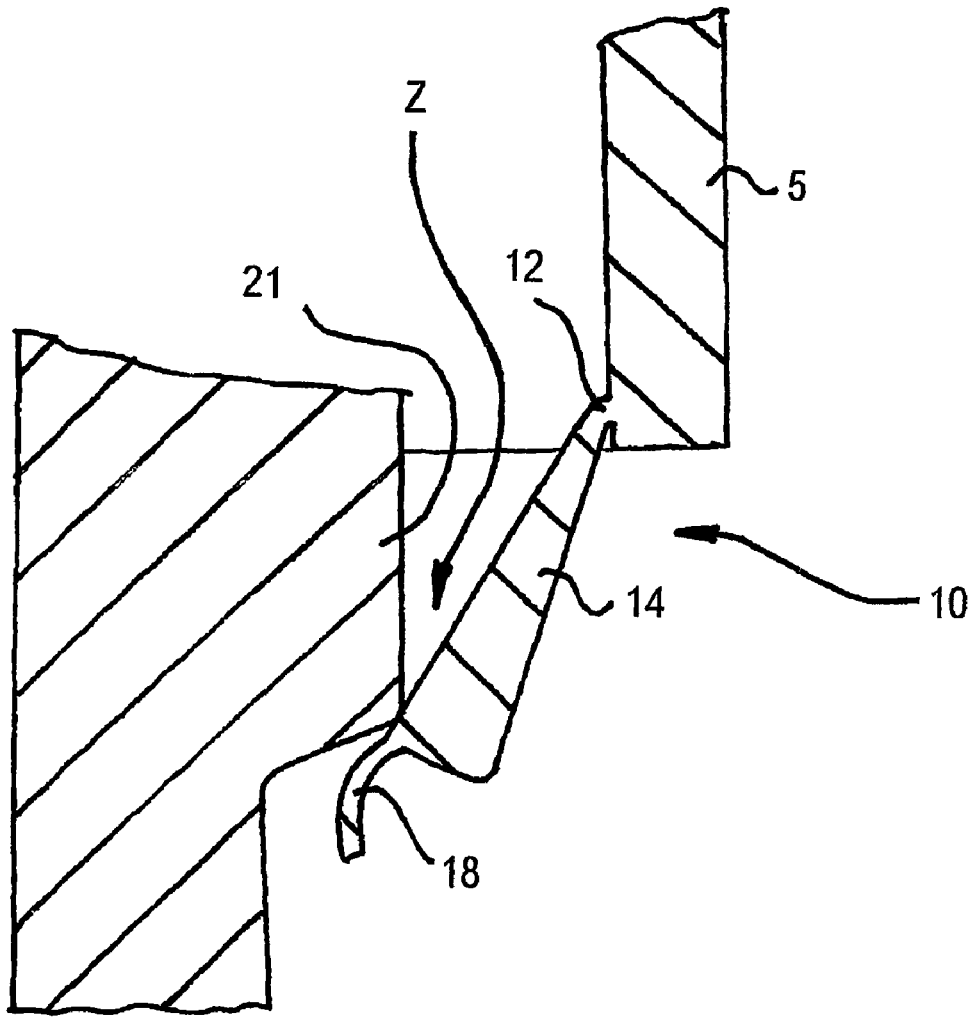
FIG. 4 is a cross-section like the one in FIG. 1, showing the fin members in a further configuration.

As shown in FIG. 4, can occur that, if the cap 1 is associated with a defective container 9, during the first opening thereof, the fins 10 may rotate around the deformable zone 12, thereby overturning.

In this case, the appendages 18 can have a further configuration, indicated with Z, wherein an outer surface 20 of each one of the appendages 18 interacts with the projection 21 in such a way as to prevent the opening-indicator ring 5 from detaching from the neck 8.

In other words, the fins 10 of the cap 1 according to the invention are shaped in such a way as to be effective even if associated with defective containers.

Figure 5:
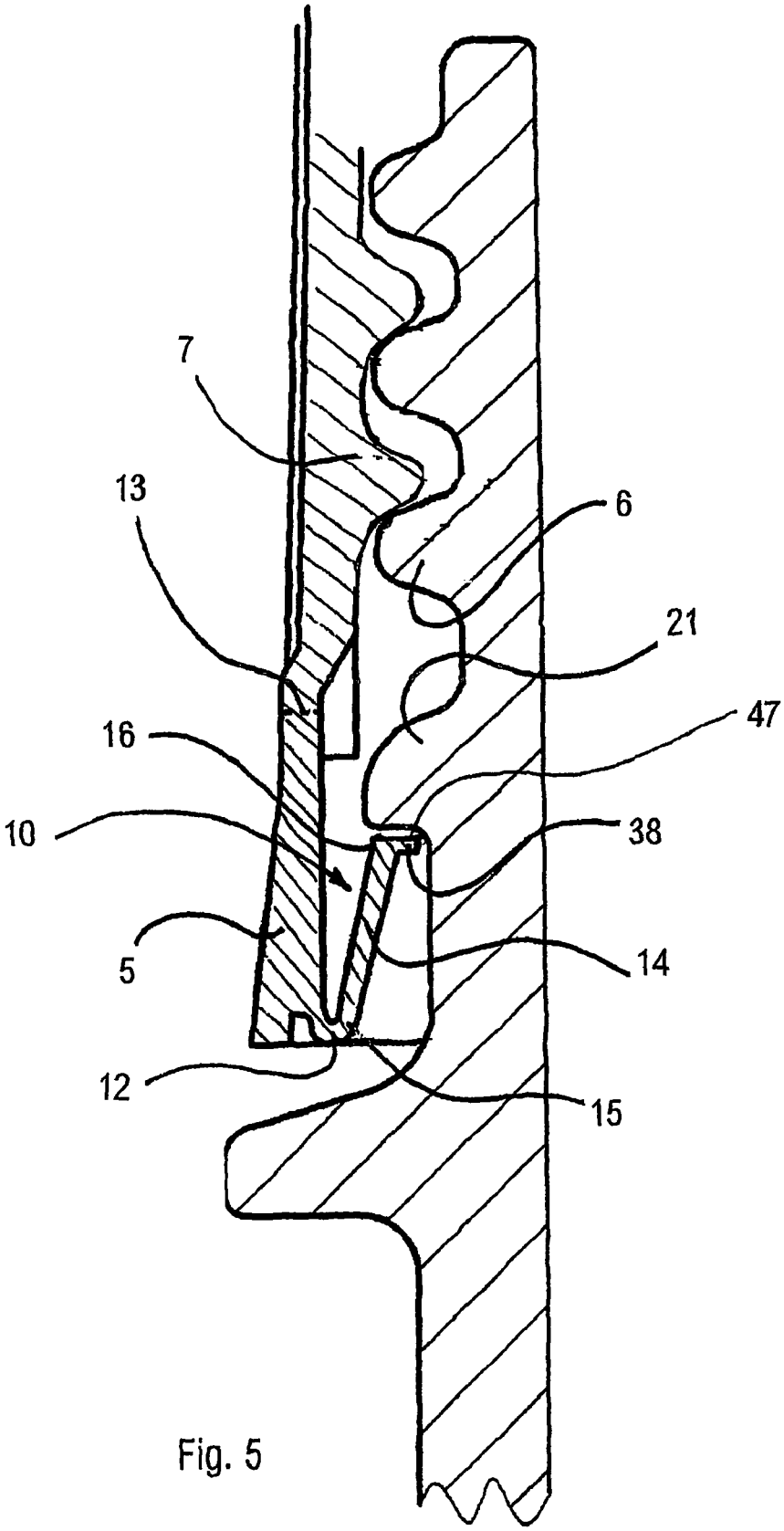
FIG. 5 is a cross-section like the one in FIG. 1, showing a version of the cap arrangement according to the invention.

With reference to FIG. 5, it has been shown a cap 1 comprising fins 10 each one of which is provided with an elongated element 14 having a first end 15 connected with the deformable zone 12 and a second end 16, opposite the first end 15, to which a further appendage 38 is connected.

The further appendage 38 extends transversely in relation to the elongated element 14 and is suitable for interacting with a projection 21 to promote, during a first opening of the container 9, breaking of bridge elements that define a nominal opening line 13 extending circumferentially around the lateral surface 3 of the cap 1.

In an embodiment, the further appendage 38 extends in a substantially perpendicular manner in relation to the elongated element 14.

The further appendage 38 comprises a zone 47 that is arranged to interact with the projection 21 and that has a considerable surface extension, which enables the interaction between the fin 10 and the projection 21 to be optimised.

The further appendage 38 is further provided with high deformability if it is subjected to stress directed radially from the centre of the cap 1 towards the periphery thereof.

This enables the maximum torque value to which the cap has to be subjected at the moment of its application to the neck 8, to be considerably reduced.

Figure 6:
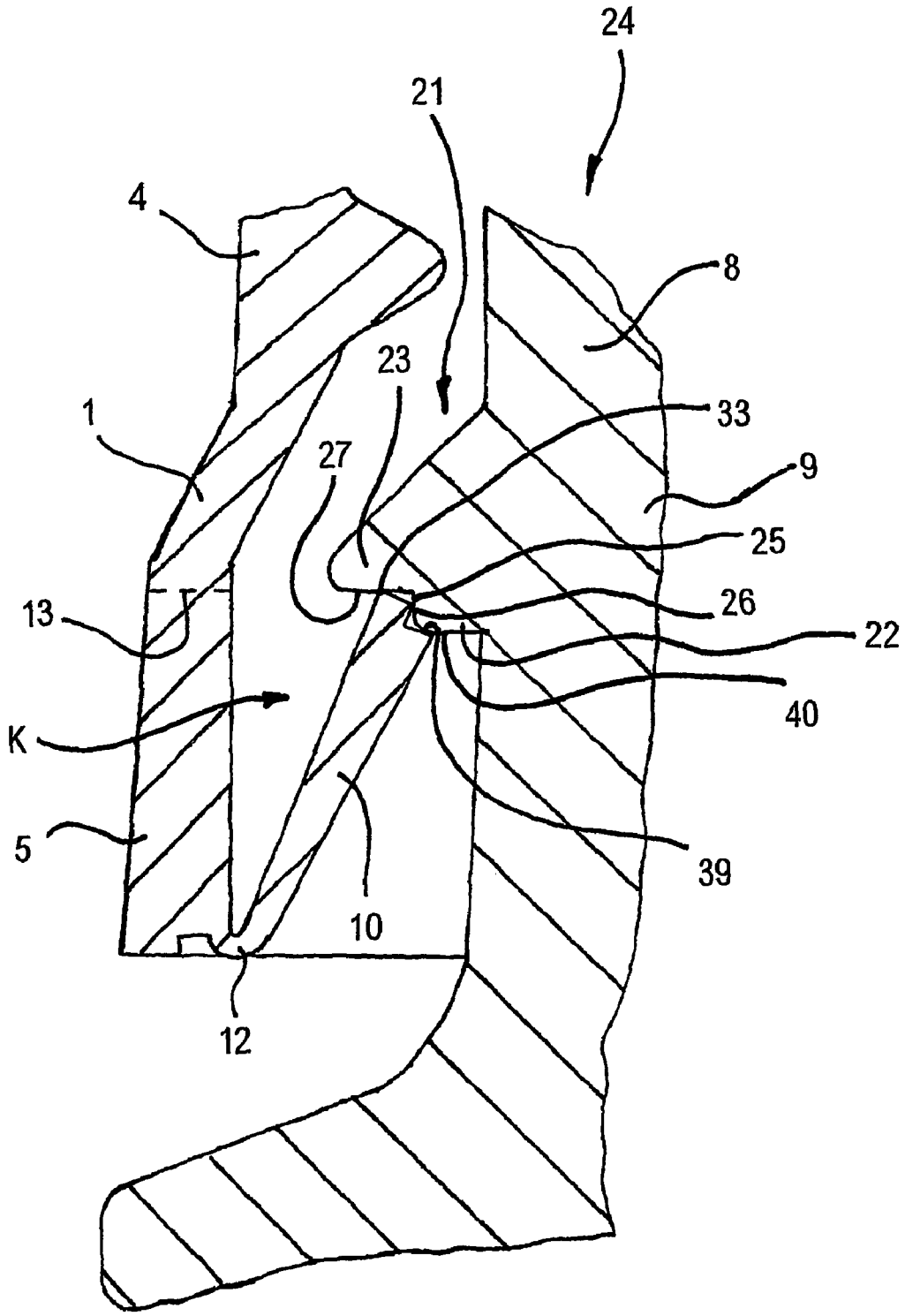
FIG. 6 is a cross-section like the one in FIG. 1, showing a further version of the cap arrangement according to the invention.
Figure 7:
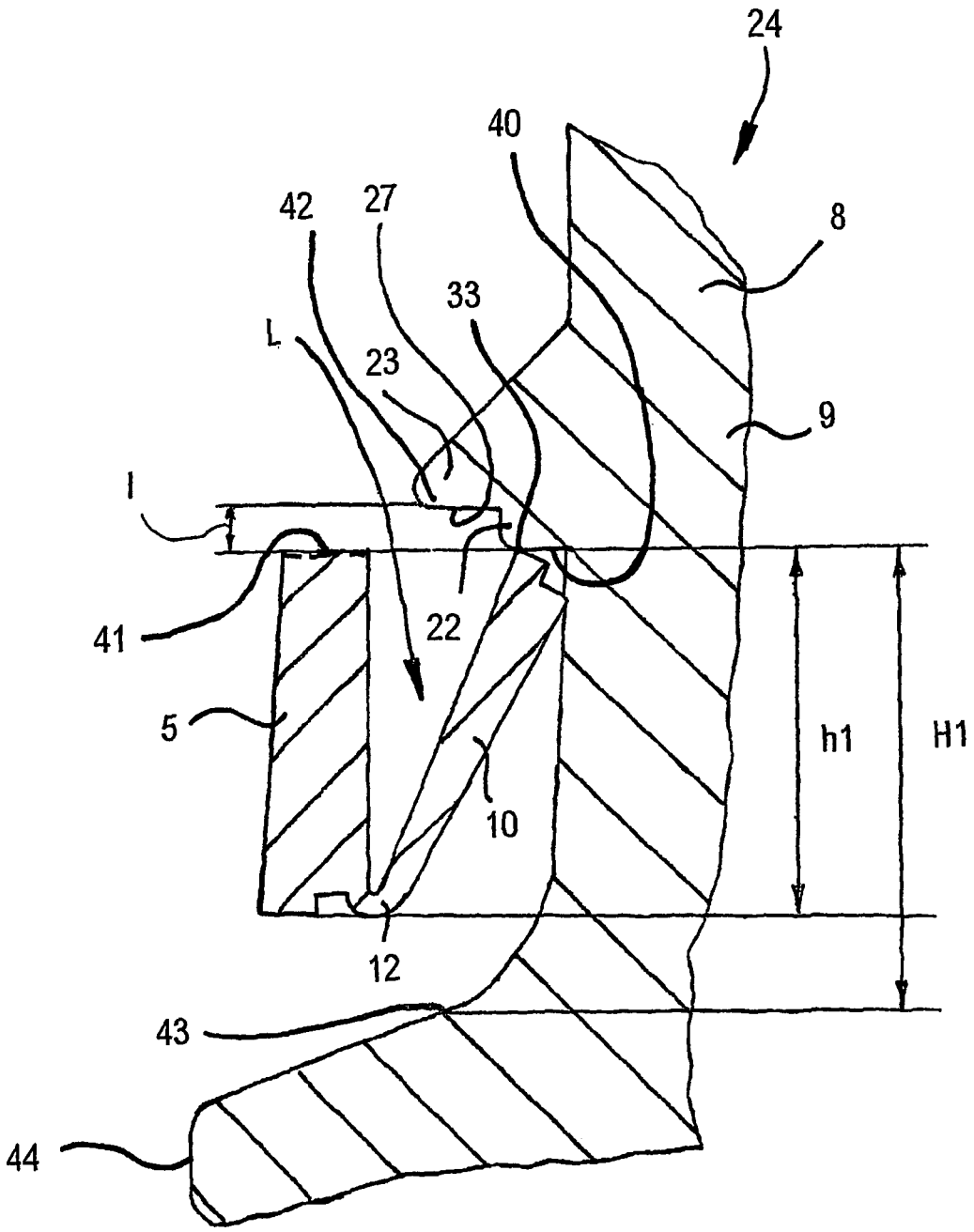
FIG. 7 is a cross-section like the one in FIG. 6, showing the fin members after the opening-indicator device has been separated from a body of the cap arrangement, once a first opening of the container has occurred.

With reference to FIGS. 6 and 7, it has been shown a cap 1 made according to a version and suitable for being associated with a container 9 provided with a projection 21 comprising a first collar 22 and a second collar 23.

The first collar 22 is obtained in a portion of the neck 8 that is further away from an opening zone 24 of the container 9 in relation to a further portion of the neck 8 in which the second collar 23 is obtained.

The first collar 22 and the second collar 23 are radially projected from the neck 8, so as to be adjacent to one other.

The second collar 23 has a diameter that is greater than the diameter of the first collar 22.

The cap 1 is provided with fins 10 comprising a first portion 26 suitable for interacting with a first surface 25 obtained in the first collar 22, a second portion 33 suitable for interacting with a second surface 27 obtained in the second collar 23 and a third portion suitable for interacting with a third surface 40 obtained in the first collar 22.

The first surface 25 has a cylindrical development and extends substantially parallel to the external surface of the neck 8.

The second surface 27 has an annular development and extends in a substantially perpendicularly in relation to the first surface 25.

The third surface 40 has an annular development and extends substantially parallel to the second surface 27.

The first surface 25 constitutes stop element preventing overturning of the fin around the deformable zone 12.

The second surface 27 and the third surface 40 constitute backing elements that, during the first opening, cooperate with, the fins 10 to facilitate the breaking of the bridge elements.

In this way, the opening-indicator ring 5 is prevented from separating from the neck 8 after that the breakage of the bridge elements connecting the neck 8 to the body 4 fails during the first opening of the container 9.

Furthermore, the interaction of the first portion 26, of the second portion 33 and of the third portion 39 with the first surface 25, the second surface 27 and the third surface 40, respectively, makes the fins 10 to work substantially under buckling stress, in order words to be prevailingly affected by compression stresses.

In this way, the fins 10 are subjected to limited deformation and cause rapid breakage of the bridge elements interposed between the body 4 of the caps and the opening-indicator ring 5.

In other words, the first collar 22 and the second collar 23 limit the possibility of the fins 10 being deformed by flexure.

In particular, the first surface 25 prevents the fins 10 from rotating around the deformable zone 12, thus eliminating the danger that the bridge elements are not broken during opening of the container 9 and that the opening-indicator ring 5 is removed from the neck 8 by remaining connected to the body 4.

The result is that the first surface 25 prevents the container 9 from being opened and possibly closed again without a user being made fully aware of the separation of the opening-indicator ring 5 from the body 4.

Each fin 10 takes on, during a first opening of the container 9, a configuration indicated with K in FIG. 6, in which the first portion 26 interacts with the first surface 25, the second portion 33 interacts with the second surface 27, and the third portion 39 interacts with the third surface 40.

Each fin 10 can furthermore, once the first opening of the container 9 has occurred, take on a further configuration indicated with L in FIG. 7, in which the fin is arranged below the first collar 22.

In particular, in the further configuration L, the second portion 33 interacts with the third surface 40 rather than with the second surface 27, in such a way as to remove the opening-indicator ring 5 from the projection 21.

When the fin is in the further configuration L, in fact, an upper end zone 41 of the opening-indicator ring 5 is separated from a lower end zone 42 of the projection 21 by a distance 1 having an extension that is such as to enable unequivocal recognition of the fact that opening of the container 9 has taken place.

Each fin 10 can take on the further configuration L inasmuch as its height hi is less than the distance between the first collar 22 and an end 43 of the neck 8 from which a rounded portion 44 of the container 9 leads away.

Figure 8:
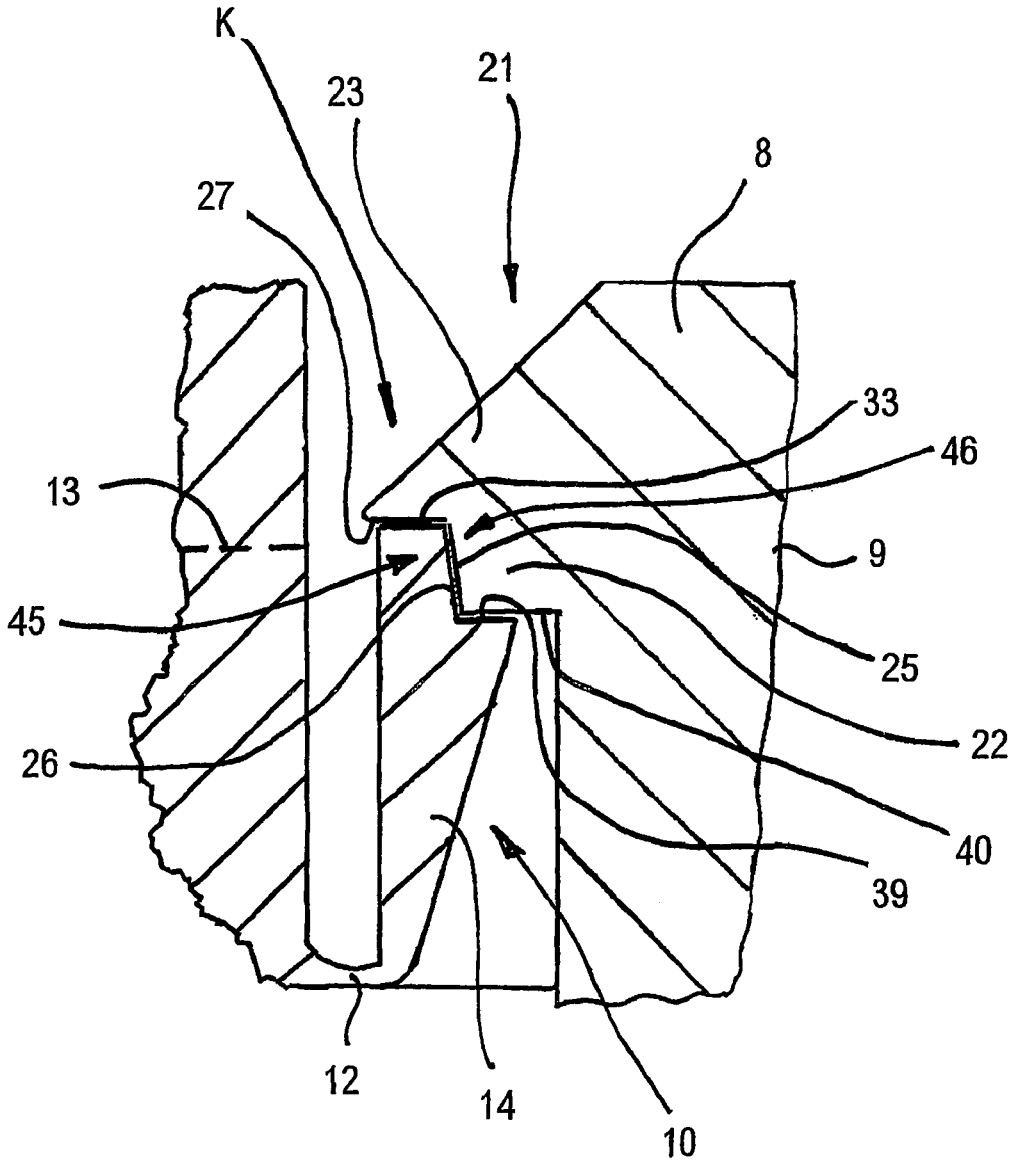
FIG. 8 is a partial cross-section taken along a transverse plane of one embodiment of the cap arrangement shown in FIG. 6.

With reference with FIG. 8, it has been shown a version of the cap 1 illustrated in FIGS. 6 and 7.

The cap 1 comprises a fin 10 provided with a first portion 26, a second portion 33 and a third portion 39 that are connected to each other in such a way as to give the fin 10 a step contour 45 that is suitable for engaging in shapingly coupled manner, when the fin is arranged in the configuration K, with a further step contour 46 defined by the first surface 25, by the second surface 27 and by the third surface 40.

Figure 9:
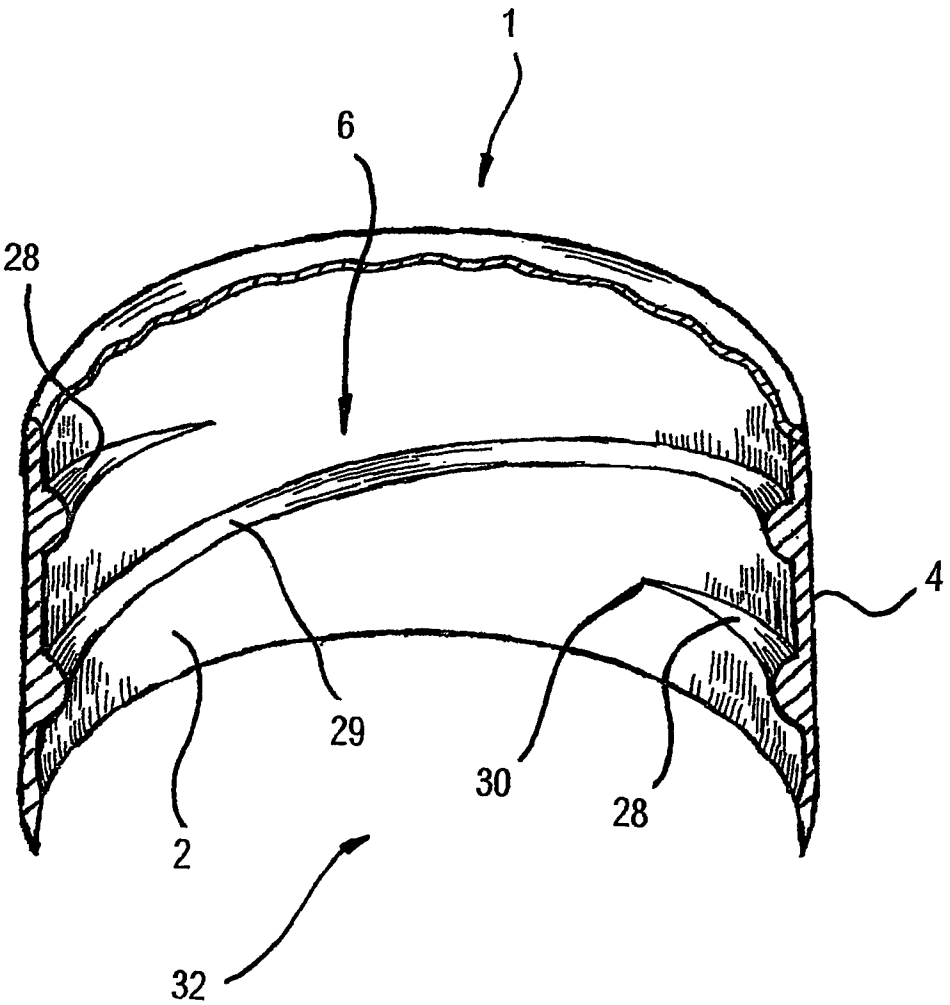
FIG. 9 is a perspective cross-section view of cap arrangement according to the invention, made according to a further version.
Figure 10:
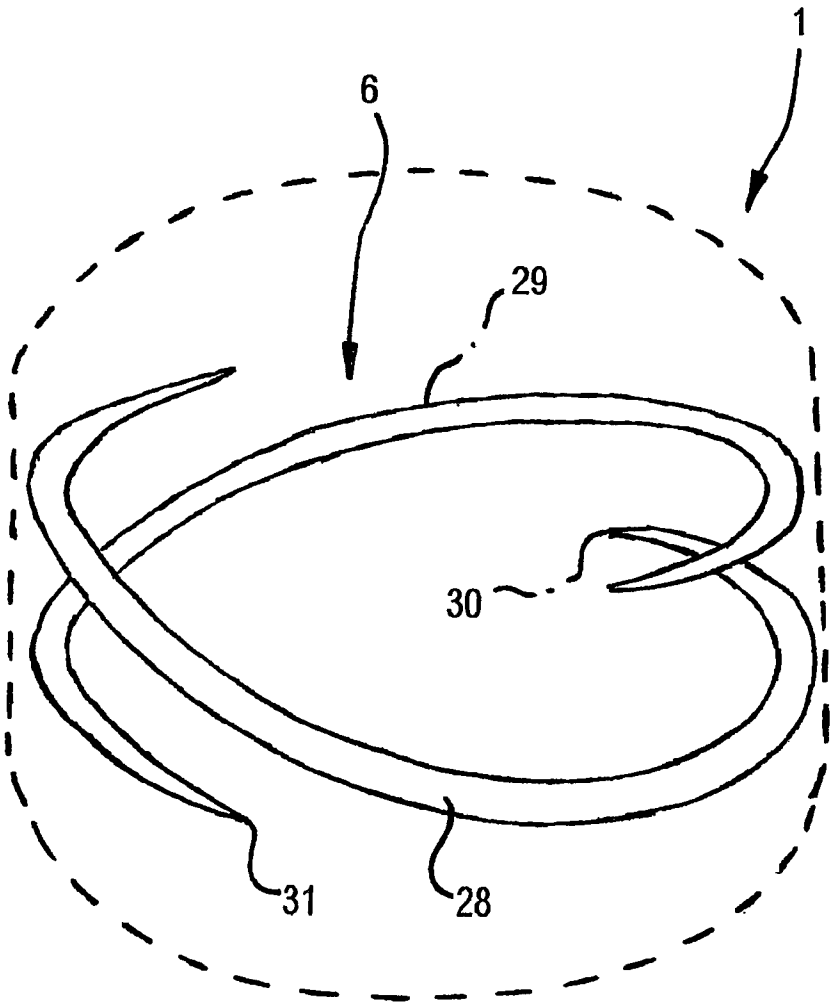
FIG. 10 is a transparent schematic cross-section view of the cap arrangement in FIG. 9.
Figure 11:
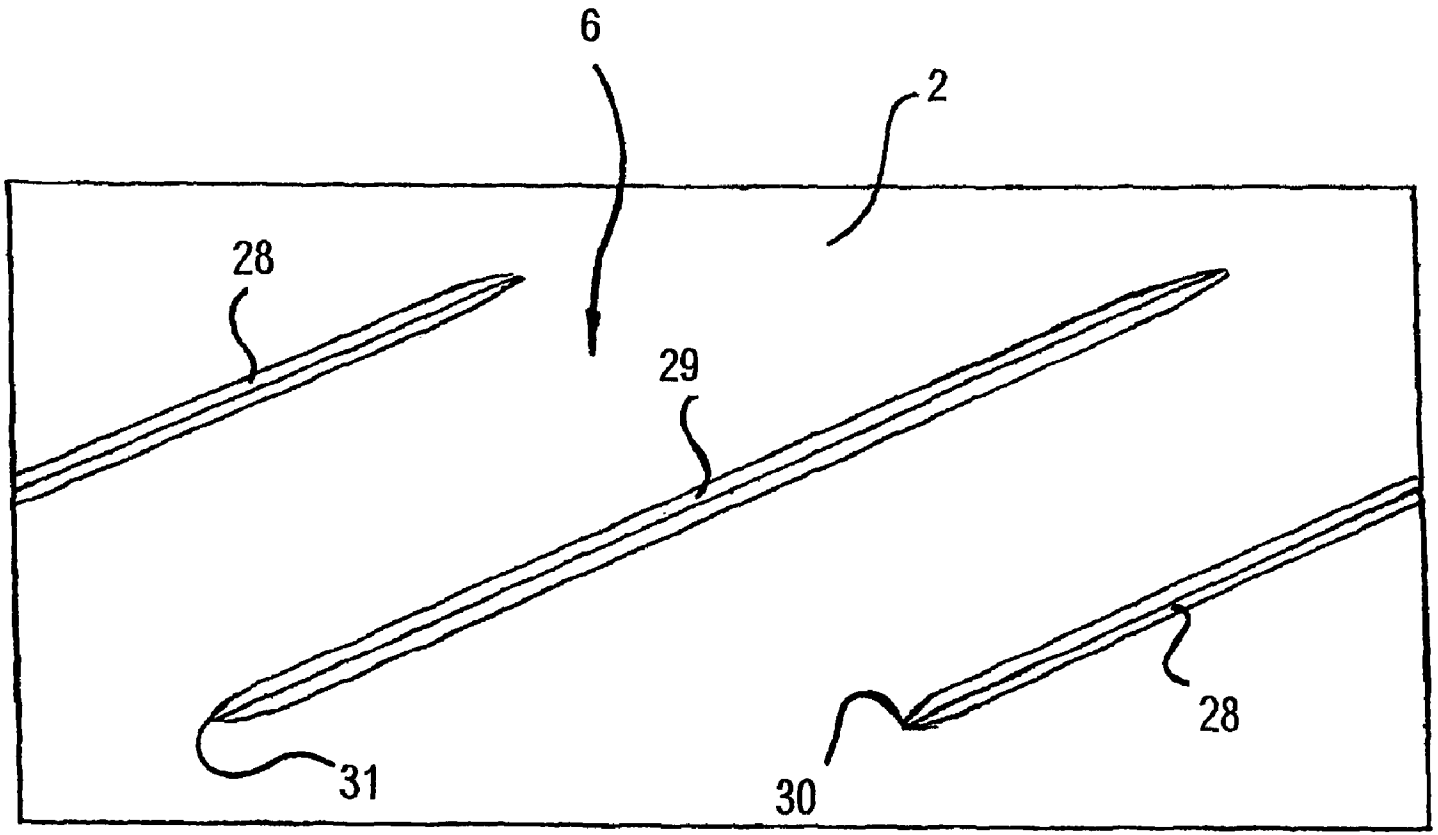
FIG. 11 is a development on a plane of the internal cylindrical lateral surface of the cap arrangement in FIG. 6, highlighting thread of the cap arrangement.

FIGS. 9 to 11 show a cap 1 inside which is obtained a thread 6 suitable for engaging with a further thread 7 obtained in a neck 8 of a container 9.

The thread 6 comprises a first thread 28 and a second thread 29 extending parallel along the internal surface of the body 4.

The first thread 28 is provided with a first start 30 arranged on a plane whereupon is also arranged a second start 31 with which the second thread 29 is provided, said plane being substantially parallel to a further plane identified by an opening 32 of the cap arrangement 1 within which the neck 8 can be received.

The invention claimed is:

1. A cap arrangement, comprising an opening-indicator device having an outer edge wherefrom fin members lead away and extend, in use, internally of said cap arrangement, said fin members being intended to form an abutment for projection elements projecting from a neck of a container arrangement with which said cap arrangement can be associated, said fin members comprising an elongated element extending substantially rectilinearly from said opening-indicator device, said fin members further comprising flexible appendage elements forming a free end of said fin members, said elongated element having a first end connected with said opening-indicator device and a second end, opposite said first end, to which said appendage elements are connected, said flexible appendage elements having a substantially uniform thickness, said appendage elements leading away from said second end and being thinner than said second end such that said second end has, contiguously to said appendage elements in a direction of said uniform thickness, a zone of interaction adapted to abut against said projection elements, said first end comprising a deformable zone acting as plastic hinge to connect said elongated element to said opening-indicator device, said appendage elements being movable between a folded configuration in which, during the application of said cap arrangement to the neck of the container, said appendage elements are contained in the thickness of said elongated element, and an extended configuration in which said appendage elements extend substantially transversely from said elongated element and in which said appendage elements have a curved profile adapted to partially surround said projection elements when said zone of interaction abuts against said projection elements in such a way as to prevent overturning of said fin members around said deformable zone during the first opening of the container.

2. The cap arrangement of claim 1, wherein said elongated element is oscillatable around said edge.

3. The cap arrangement of claim 1, wherein said elongated element has a wedge-like longitudinal section.

4. The cap arrangement of claim 1, wherein said elongated element is in a proximal portion of said fin members closer to said edge, and wherein said flexible appendage elements are in a distal portion of said fin members farther away from said edge.

5. The cap arrangement of claim 1, wherein said appendage elements can be deformed if subjected to stress directed radially from a central zone of said cap arrangement towards a peripheral zone of said cap arrangement.

6. The cap arrangement of claim 1, wherein said fin members have a thickness that is less than the difference between the diameter of said projection elements and the diameter of said neck.

7. The cap arrangement of claim 1, wherein said fin members are of a height that is less than the distance between said projection elements and a shaped part of said container arrangement extending radially from said neck.

8. The cap arrangement of claim 1, wherein said elongated element is substantially subjected to compression stress, during a first opening of said container arrangement.

9. The cap arrangement of claim 1, wherein said appendage elements are shaped in such a way as to interact in a shapingly coupled manner with said projection elements, during said first opening, to prevent said fin members from rotating around said opening-indicator device.

10. The cap arrangement of claim 1, wherein said opening-indicator device comprises a ring having an intended separation line system extending longitudinally along the surface of said ring.

11. The cap arrangement of claim 1, wherein the zone of interaction and each appendage element is positioned side-by-side at the second end of the elongated element with the appendage element extending from an outer radial edge of the elongated element.

12. The cap arrangement of claim 1, wherein the appendage elements are movable relative to the elongated elements.

13. The cap arrangement of claim 1, wherein the zone of interaction is adapted to extend substantially along the second end and extends substantially transverse to a longitudinal axis of the elongated element, the appendage element being formed as a continuous extension of the zone of interaction, the appendage element being adapted to interact and contact with the projection elements in the extended configuration.

14. The cap arrangement of claim 1 and further comprising a threaded device suitable for engaging in a corresponding further threaded device obtained in a container arrangement with which said cap arrangement can be associated.

15. The cap arrangement of claim 14, wherein said threaded device comprises a thread provided with double starts.

16. The cap arrangement of claim 15, wherein said double starts are contained on the same plane that is substantially parallel to a further plane identified by an opening of said cap arrangement.

17. The cap arrangement of claim 15, wherein said double starts are mutually staggered by an angle of 180°.

18. The cap arrangement of claim 15, wherein said thread comprises a pair of threads with cylindrical helix extending parallel to one another.

19. The cap arrangement of claim 15, wherein said thread comprises a pair of threads with tapered helix extending parallel to one another.

* * * * *